US006422278B1

(12) United States Patent
Grogan

(10) Patent No.: US 6,422,278 B1
(45) Date of Patent: Jul. 23, 2002

(54) NESTED CONVERTIBLE HANDBAGS

(76) Inventor: Katy A. Grogan, 45 Hillside Rd., Bronxville, NY (US) 10708

( * ) Notice: Subject to any disclaimer, the term of this patent is extended or adjusted under 35 U.S.C. 154(b) by 0 days.

(21) Appl. No.: 09/730,051

(22) Filed: Dec. 5, 2000

(51) Int. Cl.[7] ..... A45C 13/08
(52) U.S. Cl. ..... 150/105; 150/107
(58) Field of Search ..... 150/105, 104, 150/103, 107

(56) References Cited

U.S. PATENT DOCUMENTS

| | | | | | |
|---|---|---|---|---|---|
| 1,960,396 | A | * | 5/1934 | Rosenberg | 150/105 |
| 1,990,360 | A | * | 2/1935 | Anish | 150/105 |
| 2,053,464 | A | * | 9/1936 | Dalsheim | 150/105 |
| 2,131,382 | A | * | 9/1938 | Lobel | 150/105 |
| 2,437,382 | A | * | 3/1948 | Czap | 150/105 |
| 4,088,167 | A | * | 5/1978 | Schwartz | 150/107 |
| 4,716,947 | A | * | 1/1988 | Haddock | 150/105 X |
| 4,907,633 | A | * | 3/1990 | Eckstein | 150/105 |
| 5,207,254 | A | * | 5/1993 | Fromm | 150/104 |
| 6,029,723 | A | * | 2/2000 | Baquero et al. | 150/105 |
| 6,129,126 | A | * | 10/2000 | Restivo | 150/105 |
| 6,179,025 | B1 | * | 1/2001 | Sutton | 150/105 |
| 6,186,201 | B1 | * | 2/2001 | Salz | 150/105 |

* cited by examiner

*Primary Examiner*—Lee Young
*Assistant Examiner*—Tri M. Mai
(74) *Attorney, Agent, or Firm*—John G. Costa

(57) ABSTRACT

A pair of nested handbags which can also function as independent units. The inner handbag can be secured to any one of a plurality of outer handbags having different colors and styles. The method of securing the handbags to each other is through a simple mechanism of flexible straps and snaps that can also serve to hold carrying handles.

1 Claim, 4 Drawing Sheets

NESTED CONVERTIBLE HANDBAGS

BACKGROUND OF THE INVENTION

1. Field of the Invention

This invention relates to the field of handbag design and construction, in particular, to the design and construction of a pair of nested handbags which can also serve as separate units.

2. Description of the Related Art

The use of handbags is well known in the prior art. Many designs and configurations are represented, with attractiveness, ease of use, portability, security, ease of content organization and usable capacity relative to overall size being advantageous factors. Recently, attention has been given to convertible or nested handbags, wherein an inner, removable handbag is wholly contained within an outer handbag. The outer handbag may belong to a set of differently styled similar units and, thereby, serve merely as a shell, providing a way to change the outer appearance of the combined unit, while not appreciably affecting the storage or organization of items within the inner handbag. Steinhart (U.S. Pat. No. 5,911,262) provides a handbag comprising an inner handbag disposed within an outer handbag, thereby allowing the user to easily transfer the contents of a purse into a variety of variously designed and colored handbags. Barbaresi (U.S. Pat. No. 4,112,991) provides a convertible handbag comprising a rigid outer basket-like frame within which a soft fabric inner bag is fastened by wing-like flaps and a handle chain. Like the handbag provided by Steinhart, the convertible handbag of Barbaresi has as a major object the provision of a handbag that can be changed in style and color. Briganti (U.S. Pat. No. Des. 408,146), Briganti (U.S. Pat. No. Des. 403,863) and Kohn (U.S. Pat. No. Des. 334,661) all disclose designs for handbags containing a removable liner which, like the previously cited patents, allow the organization of contents and the transfer of said organized contents into other ornamental outer containers.

While the capability of changing styles is a major advantage of convertible and nested handbags, the ease with which the change can be effected is equally important. Another important advantage of the nested design, is the possibility of using each member of the pair of handbags as a separate and independent entity. In the former regard, the handbag provided by Barbaresi requires the inner bag to be secured to the outer bag by the weaving of a chain through openings that are positioned beneath rigid wings on the outer shell. Achieving this interconnection could require a level of manipulation that is difficult for elderly people or people whose dexterity is compromised. In a similar way, equally disadvantageous to some users, the handbag provided by Steinhart requires that flaps from the inner bag be passed through slots in the outer bag. As regards the advantageous possibility that each bag could be used as a separate entity, neither the handbags of Steinhart, Barbaresi, Briganti nor Kohn provide that possibility. The handbag of Barbaresi comprises a rigid outer shell containing a soft inner bag. The rigid shell is not intended to be used alone, whereas the soft inner bag, if unsupported by the rigid outer shell, may lack the structural integrity to serve as an independent unit. The handbag of Steinhart comprises an inner bag with substantial storage flaps that are intended to be inserted through slots in the outer bag to secure it. These flaps would be a hinderance if the inner bag were to be used as an independent unit without the surrounding aspect of the outer bag. Finally, it should be noted that the handbag of Barbaresi utilizes its carrying handle as an integral part of the mechanism by which the inner and outer portions are secured. This makes it impossible to use such a handbag without carrying handles, which might be desirable in certain instances. The designs of Briganti and Kohn clearly anticipate the inner container to be only a liner and not to provide the possibility of its use as a separate entity. In light of these deficiencies of convertible and nested handbags bags of the prior art as well as handbags designed with removable liners, the present invention provides a novel handbag design and construction that combines ease of changing the outer style of the handbag as a combined unit, while still providing the use of an inner and an outer handbag as independent and separate units.

SUMMARY OF THE INVENTION

A first object of this invention is to provide a pair of nested handbags, comprising an inner handbag and an outer handbag secured to each other.

A second object of this invention is to provide a pair of nested handbags wherein the outer handbag can be easily interchanged with other similar units so as to permit color and stylistic variations of the combined unit.

A third object of this invention is to provide a pair of nested handbags wherein the inner handbag can be easily transferred to and secured within any one of a plurality of outer handbags without disturbing its contents or organization.

A fourth object of this invention is to provide a pair of nested handbags which can also serve as separate and independent units.

A fifth object of this invention is to provide a pair of nested handbags, to be used together or separately, with detachable carrying handles.

These objects are achieved by the use of a novel configuration of snaps disposed along small flexible straps affixed within each bag. When the bags are nested, the female snaps on the straps of the outer bag connect to the male snaps within the inner bag, thus easily securing the bags to each other without the necessity of complex or difficult manipulations. The same strap/snap combination can be used to secure carrying straps or handles to the outer bag so as to enable the combined unit to be easily carried. When the bags are to be used separately, the strap/snap combinations hang down within the bags so as not to interfere with the contents of the bag and to be well concealed or, equally advantageously, they may be snapped together to themselves. If they are snapped together to themselves, the strap/snap combinations can be used to secure carrying straps to the bags when they are used separately.

In general, herein disclosed is a pair of nested handbags comprising an outer handbag, said outer handbag comprising at least two side pieces, each side piece comprising an inner facing surface, an end of each of two straps of upwardly directed flexible material being affixed to the inner facing surface of each of at least two outer handbag side pieces, attached to each upwardly directed strap is a lower fastener and an upper fastener, a lower fastener on an upwardly directed strap being situated closer to the attached end of a corresponding upwardly directed strap than is an upper fastener on the same upwardly directed strap, aligned with each upwardly directed strap and attached below each upwardly directed strap to the inner facing surface of a corresponding side piece of said outer handbag are a lower fastener and an upper fastener, each lower fastener situated on an inner facing surface of an outer bag side piece is a mate of a corresponding upper fastener situated on a corresponding outwardly directed strap and each upper fastener situated on an inner facing surface of an outer bag side piece is a mate of a corresponding lower fastener situated on a corresponding outwardly directed strap; an inner handbag, of smaller dimensions than the outer handbag, said inner handbag comprising at least two side pieces, each side piece comprising an inner facing surface, an end of each of two straps of inwardly directed flexible material being affixed to the inner facing surface of each of at least two inner handbag side pieces, attached to each inwardly directed strap is a lower fastener and an upper fastener, an upper fastener on an inwardly directed strap being situated closer to the attached end of a corresponding inwardly directed strap than is a lower fastener on the same inwardly directed strap, aligned with each inwardly directed strap and attached above each inwardly directed strap to the inner facing surface of a corresponding side piece of said inner handbag are a lower fastener and an upper fastener, each lower fastener situated on an inner facing surface of an inner bag side piece is a mate of a corresponding upper fastener on a corresponding inwardly directed strap and each upper fastener situated on an inner facing surface of an inner bag side piece is a mate of a corresponding lower fastener situated on a corresponding inwardly directed strap; each lower fastener situated on an inner facing surface of an inner bag side piece is a mate of a corresponding upper fastener on a corresponding outwardly directed strap of an outer bag and each upper fastener situated on an inner facing surface of an inner bag side piece is a mate of a corresponding lower fastener situated on a corresponding outwardly directed strap of an outer bag.

In one variation of the nested handbags herein disclosed each upper fastener situated on an inner facing surface of an inner bag side piece is a mate of a corresponding lower fastener situated on a corresponding inwardly directed strap and wherein said corresponding lower fastener situated on a corresponding inwardly directed strap is oriented to face towards the interior of the inner handbag when said inwardly directed strap hangs freely and fully extended inside the inner handbag.

In another variation of the nested handbags herein disclosed each upper fastener situated on an inner facing surface of an inner bag side piece is a mate of a corresponding lower fastener situated on a corresponding inwardly directed strap and wherein said corresponding lower fastener situated on a corresponding inwardly directed strap is oriented to face towards the exterior of the inner handbag when said inwardly directed strap hangs freely and fully extended inside the inner handbag.

BRIEF DESCRIPTION OF THE FIGURES

The subject matter that is regarded as the invention is particularly pointed out and distinctly claimed in the concluding portion of the specification. The invention, however, both as to organization and method of practice, together with further objects and advantages thereof, may best be understood by reference to the following description taken in connection with the accompanying drawings in which:

DESCRIPTION OF PREFERRED EMBODIMENTS

The present invention provides a pair of nested handbags, comprising an outer handbag, which may belong to a plurality of similar outer handbags of various colors and stylistic varieties, and an inner handbag, which may contain a variety of storage configurations. Each handbag is equipped with sets of snaps, disposed along flexible straps in a novel manner and configured so as to allow the inner handbag, even when its storage areas are filled, to be easily secured to any one of a plurality of outer handbags by means of joining its male snaps to the female snaps of the outer handbag. When joined by their corresponding snaps, the snapped configuration can also serve to hold a pair of carrying handles or straps. Additionally, each of the inner and outer handbags may be used separately and independently, since the snap/strap combinations can either be allowed to hang vertically downward, out of sight and in a manner that does not interfere with the use of the handbag or else can be snapped together so as to allow the attachment of carrying straps if so desired.

Figure 1:
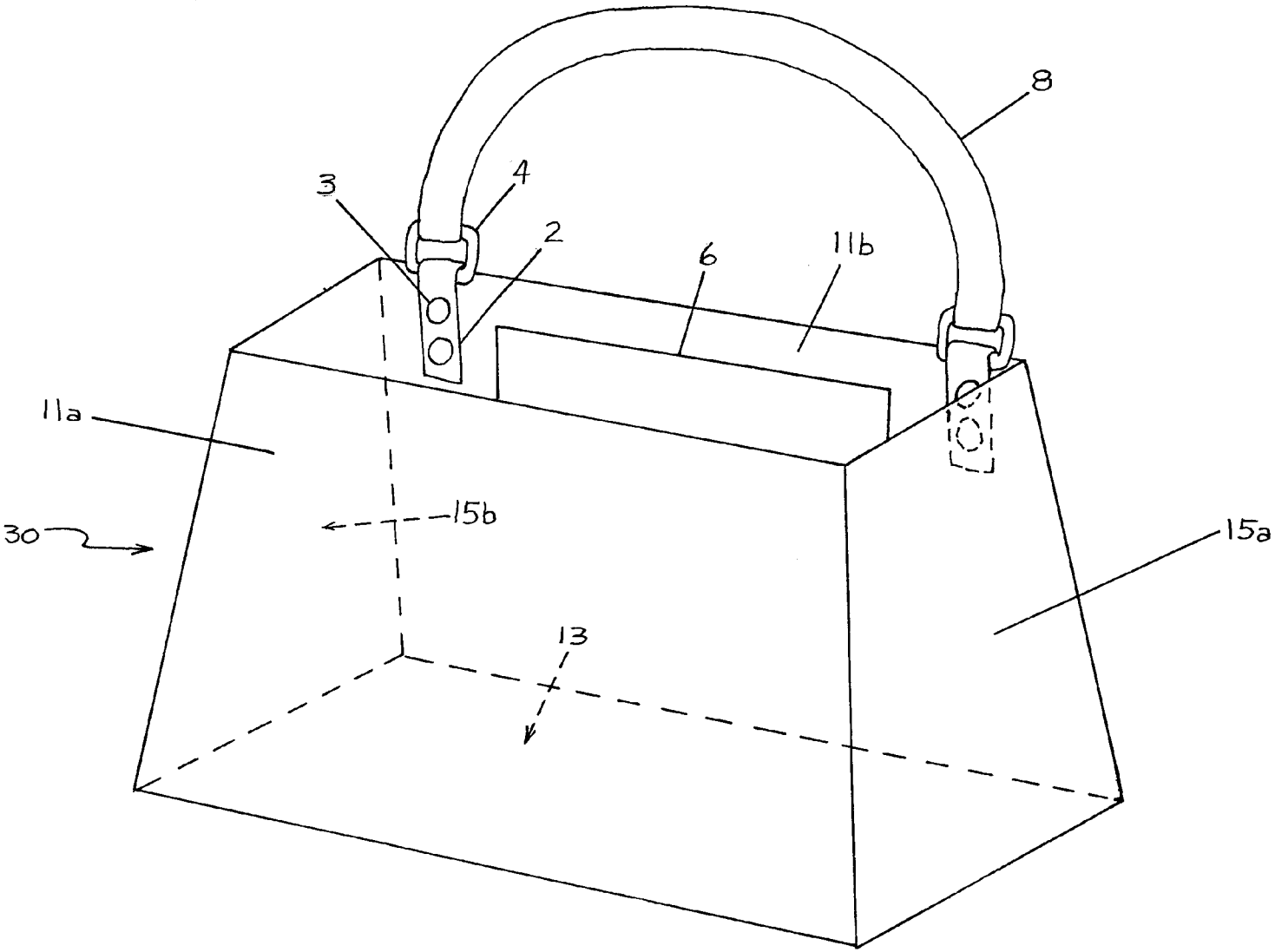
FIG. 1 is a perspective view of the outer handbag, showing a detachable carrying strap and an inner pocket.

Referring first to FIG. 1, there is shown a perspective view of the outer handbag. The body of the outer handbag in this example consists of two rectangular side pieces (11*a* & 11*b*) joined to a rectangular base (13). The side pieces are separated by two end pieces (15*a* & 15*b*) of approximately trapezoidal shape. The material and dimensions of these pieces can be varied according to the intended use of the handbag. Also shown in the figure is a carrying strap (8) attached by a metal loop (4) to a pair of snap/strap (2) arrangements, whose female snaps (3) are fastened to corresponding male snaps affixed beneath them (not shown). Although it is not shown in the figure, it is understood that the outer handbag may be decorated in a variety of fashions, including, but not limited to the use of fabrics having different colors, textures and compositions, the use of decorative borders and stitching, and the attachment of metallic escutcheons and monograms.

Figure 2:
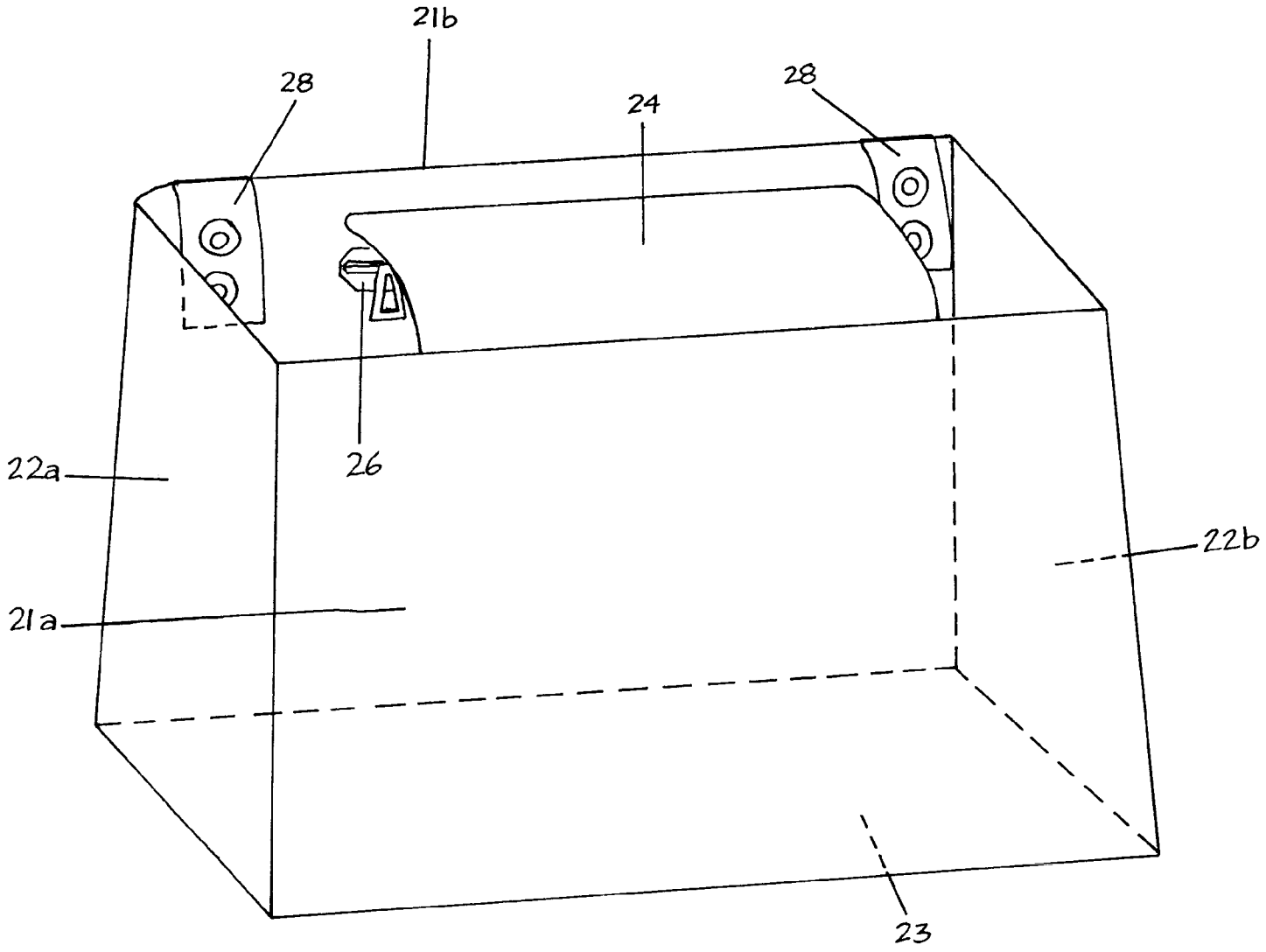
FIG. 2 is a perspective view of the inner handbag, showing the snap/strap combination hanging vertically downward and unattached to the outer bag. The view also shows a zippered compartment partially covered by a security flap, but this is to be considered only as an example of possible interior storage configurations.

Referring next to FIG. 2, there is shown a view of the inner handbag. The inner handbag comprises a pair of rectangular side-pieces (21*a* & 21*b*) attached to a rectangular base-piece (23), and separated by two rectangular end-pieces (22*a* & 22*b*). The exact dimensions of these pieces is determined by the dimensions of the outer handbag, into which the inner handbag must fit. The material of the inner handbag may also vary. The figure also shows a zippered compartment (26) and partially shows a pair of strap and snap (28) configurations hanging downward. A leather flap cover (24) can be used to further conceal the contents of the inner handbag.

Figure 3A:
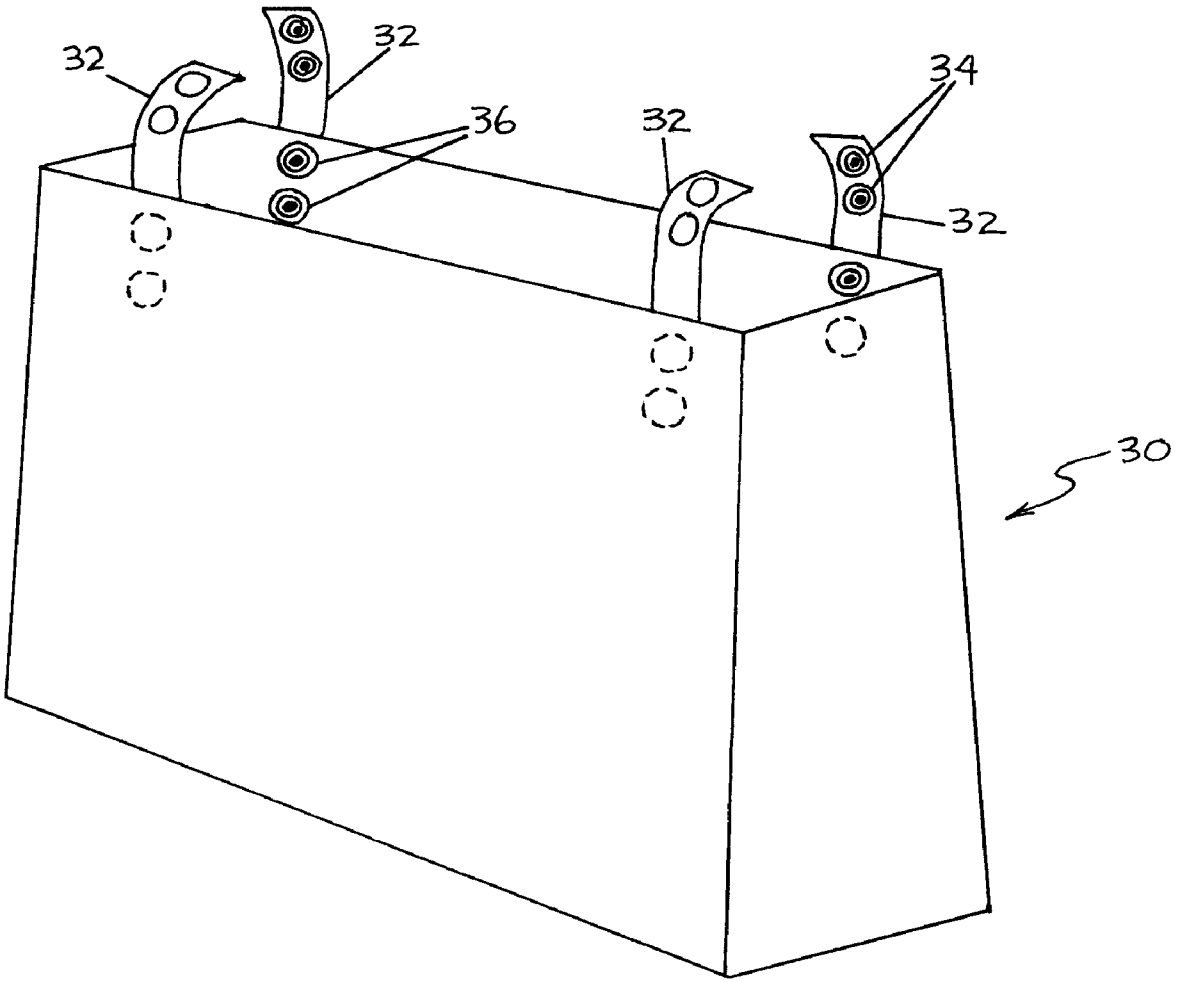
FIGS. 3*a*&*b* is a simplified perspective view (3*a*) of the outer handbag, also showing (3*b*) a separate side view of the configuration of the attached flexible straps and their snaps.
Figure 3B:
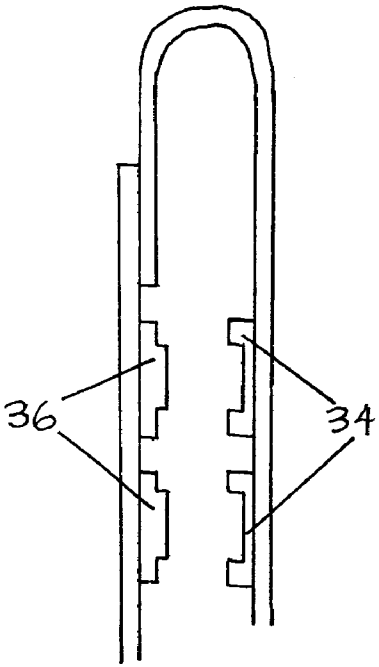

Referring next to FIG. 3*a*, there is shown a simplified view of the outer handbag (30) showing the four sets of flexible straps and snaps (32) affixed to the interior of the handbag and directed vertically upward. Each strap has two exposed female snaps (34) directed inward and there are two exposed male snaps (36) that protrude from the interior of the handbag just below the straps and also face inward. FIG. 3*b* shows how each strap can be fastened to itself by connecting the female snaps (34) to the male snaps (36), as would be the case if the outer handbag were to be used separately with attached carrying handles. When the inner bag is nested into the outer bag, however, the female snaps (34) would fasten to the corresponding male snaps (see (48) in FIG. 4*c*) within the inner handbag.

Figure 4C:
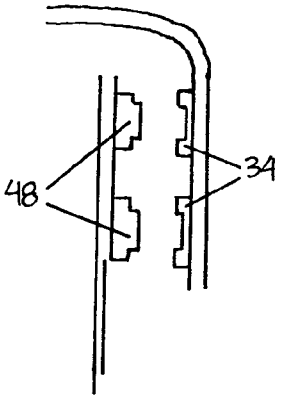
FIG. 4*c* shows how the strap from the outer handbag fastens to the snaps in the inner handbag.
Figure 4B:
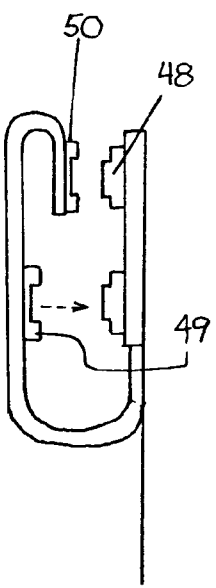
FIG. 4*b* shows how this novel snap configuration allows the strap to be folded back on itself and fastened so as to be capable of holding a carrying strap.
Figure 4A:
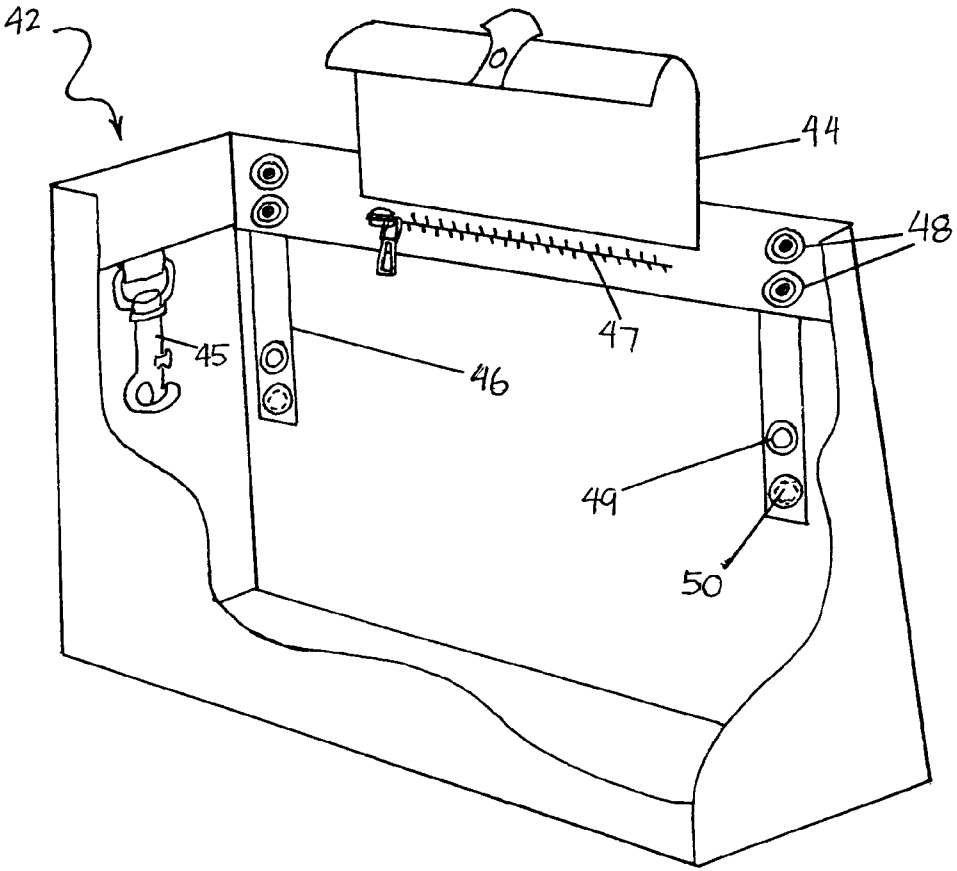
FIGS. 4*a, b* & *c* show a cut-away view of the inner handbag, showing two pairs of male snaps on an upper border and two of the snap/strap combinations hanging vertically downward exhibiting inward and outward directed female snaps in a novel configuration.

Referring next to FIG. 4*a*, there is shown a cut-away view of the inner handbag (42) showing two of its four pairs of flexible straps (46) hanging vertically downward. Each strap has two snaps on it, one snap being an outward pointing female snap (49), the other being an inward pointing female snap (50). Just above each strap is a pair of outwardly directed male snaps (48). The figure also shows a zippered compartment (47), a flap of flexible material which could be leather (44) and which could provide additional security or decoration, and an accessory fastener (45), which could serve to hold keys and other items securely within the handbag. It is expected that the inner handbag may have a variety of compartments and attachments, these are shown as examples only. FIG. 4*b* shows how the strap (46) can be folded so as to attach to the snaps (48) and form a loop. In this configuration, carrying straps can be easily and securely attached to the inner handbag allowing it be used as an independent unit, although it may be so used without the addition of carrying straps. FIG. 4*c* shows how the flexible strap and female snaps ((34) of FIG. 3) of the outer handbag will be fastened to the male snaps (48) of the inner handbag when the two are configured as a nested unit.

It is specifically noted that, although the drawings illustrate that the overall shape of the inner and outer handbags are similar and that the inner handbag is snuggly inserted into the outer handbag, the shapes of the inner and outer handbags do not have to be similar and the fit of the inner handbag into the outer handbag can vary wildly from being very snug to very loose.

As is understood by a person skilled in the art, the preferred embodiment of the present invention is illustrative of the present invention rather than being limiting of the present invention. Revisions and modifications may be made to methods, processes, materials, structures, shapes and dimensions through which is formed a pair of nested handbags which can also serve as independent units, while still providing a pair of nested handbags which can also serve as independent units, formed in accord with the present invention as defined by the appended claims.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The recitation herein of a list of desirable objects which are met by various embodiments of the present invention is not meant to imply or suggest that any or all of these objects are present as essential features, either individually or collectively, in the most general embodiment of the present invention or in any of its more specific embodiments.

What is claimed is:

1. A pair of nested handbags comprising an outer handbag and an inner handbag; said outer handbag comprising at least two first side pieces, at least two pairs of upwardly directed straps, a plurality of pairs of first fasteners, and a plurality of pairs of second fasteners; each first side piece comprising a first inner facing surface; each pair of first fasteners comprising a first lower fastener and a first upper fastener; each pair of second fasteners comprising a second lower fastener and a second upper fastener; wherein each first upper fastener is a mate of a second lower fastener and each first lower fastener is a mate of a second upper fastener; wherein two pairs of second fasteners are attached to at least two first inner facing surfaces, wherein an upwardly directed strap is attached to a first side piece above each pair of second fasteners, and wherein one pair of first fasteners is attached to each upwardly directed strap; whereby, each pair of first fasteners is aligned with a pair of second fasteners; and whereby, a folding of an upwardly directed strap permits a first upper fastener to be connected to a second lower fastener and a first lower fastener to be connected to a second upper fastener;

said inner handbag comprising at least two second side pieces, at least two pairs of downwardly directed straps, a plurality of pairs of third fasteners, a plurality of fourth fasteners, and a plurality of fifth fasteners; each second side piece comprising a second inner facing surface; each pair of third fasteners comprising a third lower fastener and a third upper fastener; wherein each third upper fastener is a mate of a fifth fastener and each third lower fastener is a mate of a fourth fastener; wherein two pairs of third fasteners are attached to at least two second inner facing surfaces; wherein an inwardly directed strap is attached to a second inner facing surface below each pair of third fasteners; wherein one fourth fastener and one fifth fastener are attached to each inwardly directed strap; wherein each fifth fastener is attached to an inwardly directed strap below a fourth fastener; wherein each fourth fastener is oriented to require a single folding of an inwardly directed strap to permit engagement of a fourth fastener with a third lower fastener, and wherein each fifth fastener is oriented to require two foldings of an inwardly directed strap to permit engagement of a fifth fastener with a third lower fastener; whereby each pair of third fasteners is aligned with a fourth fastener and a fifth fastener; whereby, a single folding of an inwardly directed strap permits a third lower fastener to engage a fourth fastener and two foldings of an inwardly directed strap permit a third upper fastener to engage a fifth fastener;

and, wherein the dimensions of said inner handbag are smaller than the dimensions of said outer handbag; wherein each said first upper fastener is a mate of a third lower fastener; and, wherein each first lower fastener is a mate of a third upper fastener; whereby said inner handbag is snuggly insertable into said outer handbag; and, whereby a folding of an upwardly directed strap permits a first upper fastener to engage a third lower fastener and a first lower fastener to engage a third upper fastener.

* * * * *